US008216340B2

(12) United States Patent
Goia et al.

(10) Patent No.: US 8,216,340 B2
(45) Date of Patent: Jul. 10, 2012

(54) METHOD FOR PRODUCING DISPERSED, CRYSTALLINE, STABLE TO OXIDATION COPPER PARTICLES

(75) Inventors: Daniel V. Goia, Potsdam, NY (US); Ionel Halaciuga, Potsdam, NY (US); Sylas LaPlante, Potsdam, NY (US); Howard David Glicksman, Durham, NC (US)

(73) Assignees: E. I. du Pont de Nemours and Company, Wilmington, DE (US); Clarkson University

( * ) Notice: Subject to any disclaimer, the term of this patent is extended or adjusted under 35 U.S.C. 154(b) by 513 days.

(21) Appl. No.: 12/396,792

(22) Filed: Mar. 3, 2009

(65) Prior Publication Data

US 2010/0224027 A1 Sep. 9, 2010

(51) Int. Cl.
*B22F 9/24* (2006.01)

(52) U.S. Cl. ..... 75/373; 75/740

(58) Field of Classification Search ..... 75/373
See application file for complete search history.

(56) References Cited

U.S. PATENT DOCUMENTS

| | | | | |
|---|---|---|---|---|
| 3,846,460 | A * | 11/1974 | Fite, Jr. | 556/114 |
| 6,451,433 | B1 | 9/2002 | Oka et al. | |
| 6,554,885 | B1 * | 4/2003 | Mende et al. | 75/365 |
| 6,875,252 | B2 | 4/2005 | Sano et al. | |
| 2007/0180954 | A1 * | 8/2007 | Kim et al. | 75/373 |

OTHER PUBLICATIONS

PCT International Search Report and Written Opinion, dated Jun. 24, 2010.

Halaciuga I. et al., method for preparing dispersed crystalline copper particles for electronic applications, Journal of Materials Research, vol. 24, No. 10, Oct. 2009, pp. 3237-3240.

* cited by examiner

*Primary Examiner* — George Wyszomierski

(57) ABSTRACT

Dispersed, crystalline, stable to oxidation copper particles are prepared in the absence of polymeric dispersants by rapidly reducing a Cu(I) salt with an Fe(II) carboxylic acid complex in water. The resulting microns sized copper powders contain only organics which decompose at temperatures low enough not to interfere with sintering processes and the formation of conductive copper structures.

6 Claims, 2 Drawing Sheets

METHOD FOR PRODUCING DISPERSED, CRYSTALLINE, STABLE TO OXIDATION COPPER PARTICLES

FIELD OF THE INVENTION

Dispersed, crystalline, stable to oxidation copper particles were prepared in the absence of polymeric dispersants by rapidly reducing a Cu(I) salt with an Fe(II) carboxylic acid complex in water. The resulting microns sized copper powders contain only organics which decompose at temperatures low enough not to interfere with the sintering process and the formation of conductive copper structures.

TECHNICAL BACKGROUND OF THE INVENTION

In the microelectronics industry, copper is used in many situations because it offers an excellent electrical conductivity at a fraction of the cost of noble metals such as gold and silver. For this reason, copper particles of various sizes and shapes are used in large quantities to build conductive structures incorporated in multi layer ceramic capacitors, printed circuit boards, and many other electronic devices. Various methods including atomization, pyrolysis, electrolysis, radiolysis, and reduction of copper salts in reverse micelles and solutions are available for preparing dispersed copper particles. Among these, precipitation in homogeneous solutions is the most versatile approach as it offers a broad range of solvents and a large variety of reductants, dispersants, and complexing agents. Most dispersed copper powders currently used in microelectronics have an average particle size between 0.5 and 3.0 micrometers and are prepared by precipitation techniques involving high molecular weight polymers as dispersants. As a result they contain residual organic matter that can adversely affect their processing into electronic devices.

U.S. Pat. No. 6,875,252 (Sano, et al) describes a copper powder and process for producing copper powder. A copper powder with a narrow particle size distribution forms a pseudo-fused sintered product. This process requires ammonia to give the desired effect.

In U.S. Pat. No. 6,451,433 Oba, et al, fine metal particle dispersion solutions are produced (colloidal solution with nanometer sized particles) using citrate ion and ferrous ion under an atmosphere having substantially no oxygen.

It would be desirable to manufacture copper powders that are easily dispersed, stable to oxidation and crystalline, without the presence of polymeric dispersants that could adversely affect their use in electronic devices.

SUMMARY OF THE INVENTION

Disclosed is a method for the manufacture of easily dispersed, stable to oxidation, crystalline, copper powders in the absence of polymeric dispersants comprising the sequential steps of:

a. forming a Cu(I) solution by dissolving a Cu(I) salt in deionized water;
b. forming a Fe(II) solution by dissolving a Fe(II) salt in deionized water;
c. forming a carboxylic acid solution by dissolving a carboxylic acid or a salt of a carboxylic acid in deionized water,
d. forming a reducing Fe (II) carboxylic acid complex solution by adding the Fe (II) salt solution to the carboxylic acid solution e. rapidly adding the reducing Fe(II) carboxylic acid complex solution to the Cu(I) solution
f. continuing to stir the solution until all of the copper has been precipitated and the particles have been formed;
g. allowing the copper particles to settle followed by removal of the supernatant, washing the copper particles, collecting them, and then drying them.

In the above process, the copper salt used is cuprous chloride, cuprous acetate or cuprous bromine. The Fe(II) salt is selected from ferrous sulfate, ferrous chloride, ferrous citrate and ferrous thiocyanate.

BRIEF DESCRIPTION OF THE FIGURES

FIG. 1(*a*) is the micrograph for Example 1 at 20° C.

FIG. 1(*b*) is the micrograph for Example 3 at 60° C.

FIG. 1(*c*) is a micrograph for the Comparative Example described at page 5, herein.

DETAILED DESCRIPTION

Figure 1A:
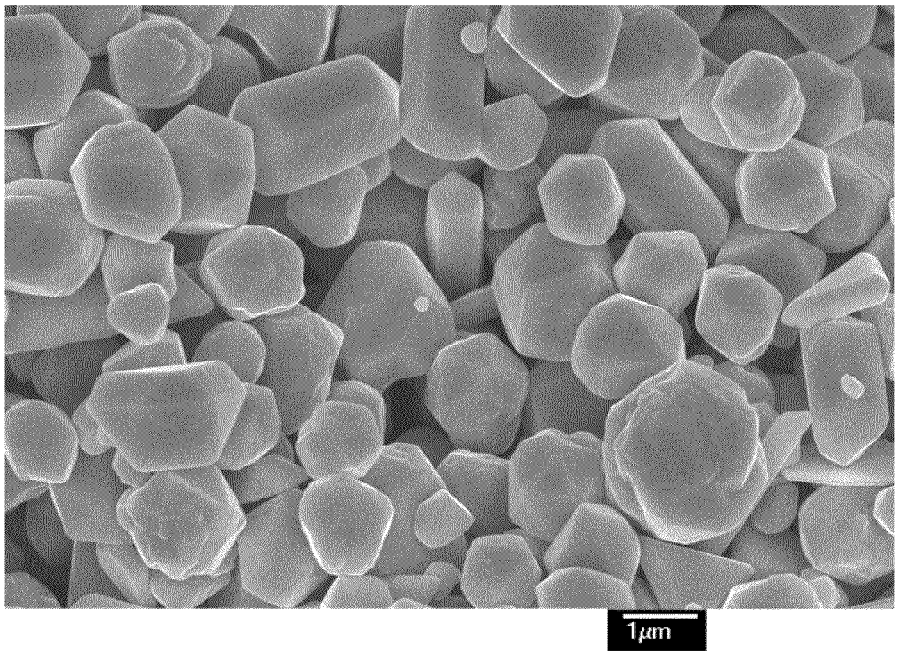
FIGS. 1(*a*), 1(*b*) and 1(*c*) show scanning micrographs of Copper Powders.

This invention involves the process where an Fe (II) carboxylic acid complex reduces a Cu(I) salt rapidly and completely to obtain well dispersed, crystalline, stable to oxidation copper particles in the absence of polymeric dispersants. The resulting copper powders contain only organics which decompose at temperatures low enough not to interfere with the sintering process and the formation of conductive copper structures.

Any Fe(II) water soluble salt can be used. Examples of suitable Fe(II) salts are ferrous sulfate, ferrous chloride, ferrous citrate, and ferrous thiocyanate. Insoluble ferrous salts are not suitable. Any Cu(I) salt can be used in this invention provided there is enough solubility to be able to form a soluble Cu(I) complex. Suitable Cu(I) salts are cuprous chloride, cuprous acetate, and cuprous bromide. It is preferred to use Cu(I) chloride. Cu(II) salts are not suitable.

One can produce the Fe(II) carboxylic acid complex solution by dissolving the Fe(II) carboxylic acid complex in water or by forming the complex by reacting a dissolved Fe(II) salt with the carboxylic acid or its salt. Suitable carboxylic acids include citric acid, oxalic acid, malonic acid, succinic acid and other di- and tri-acids. In addition, salts of these carboxylic acids can be used such as sodium citrate or potassium citrate. The preferred Fe(II) carboxylic acid complex is Fe(II) citrate complex formed from the reaction of Fe(II) chloride solution with a solution of sodium citrate.

By using the Fe(II) carboxylic acid complex as the reductant it is possible to reduce Cu(I) salts rapidly and completely and obtain well dispersed, stable to oxidation copper particles in the absence of polymeric dispersants. Consequently, the resulting particles contain only low decomposition temperature organic residue which does not interfere with their subsequent processing and the consolidation of highly conductive copper layers/structures. These copper particles are highly crystalline. The size of the particles can be adjusted by changing the temperature of the reaction and/or changing the concentration. Increasing the temperature from 20° C. to 60° C. causes the resulting copper particles to decrease from 1.5 microns to 0.5 microns. Decreasing the concentration of the ferrous citrate solution 25% resulted in the average particle size increasing from 1.5 microns to 2 microns.

EXAMPLES

The following examples and discussion are offered to further illustrate, but not limit the process of the invention.

Example 1

A copper salt solution was prepared by adding 23.3 g Cu(I)Cl crystals into 376.7 g deionized water in a 2 l glass beaker reaction vessel under intense mixing. A sodium citrate solution was obtained by dissolving 224 g $Na_3C_6H_5O_7 \times 2H_2O$ into 336g deionized water and a ferrous sulfate solution was prepared by dissolving 120 g $Fe(II)SO_4 \times 7H_2O$ into 280 g deionized water. The reducing Fe(II) citrate solution was prepared by mixing the two solutions of sodium citrate and ferrous sulfate together for 1 hour. Both solutions were at 20° C. The reducing Fe(II) citrate solution was then added to the reaction vessel containing the Cu(I) solution and stirred for one hour The resulting copper particles were allowed to settle and the dark green clear supernatant was removed. The settled particles were washed several times with 500 ml deionized water, rinsed three times with 300 ml alcohol, separated from the solvent by filtration, and dried at 80° C. in vacuum for several hours. The resulting copper powder had an average size of 1.5 microns as measured by a Malvern Mastersizer 2000s laser diffraction particle size distribution instrument and a crystallite size of 42 nm as measured with a Bruker D8 diffractometer. The X-ray diffraction was used to confirm the absence of copper oxide. In addition, the weight loss as determined by a Perkin Elmer Pyris 1 thermogravimetric analysis instrument was found to be 0.49% when heated in a mixture of 95% nitrogen and 5% hydrogen to 700° C.

Example 2

Decreasing the concentration of the sodium citrate solution and the ferrous sulfate solution produced a powder that was larger in size. The copper powder was prepared similarly to Example 1 except that 168 g $Na_3C_6H_5O_7 \times 2H_2O$ was dissolved into 336 g deionized water and 100 g $Fe(II)SO_4 \times 7H_2O$ was dissolved into 280 g deionized water. It had an average size of 2.0 microns.

Example 3

The copper powder was prepared similarly to Example 1 except that the reaction was done at 60° C. instead of 20° C. This copper powder had an average size of 0.5 microns with a crystallite size of 24 nm.

Conditions for these examples are summarized in Table 1.

Comparative Example using a Cu(II) salt: An Fe(II) solution was prepared by dissolving 98 g of Iron(II) sulfate heptahydrate in deionized water in a 1 liter glass beaker while adjusting the final weight of the solution to 400 g. A sodium citrate solution was prepared by dissolving 168 g of trisodium citrate dehydrate in deionized water in a 600 ml glass beaker while adjusting the final weight of the solution to 560 g. The sodium citrate solution was added rapidly to the iron(II) sulfate solution to form an iron(II) citrate solution. 29.25 g of copper(II) sulfate pentahydrate was dissolved in deionized water while adjusting the final weight of the solution to 300 g. The iron(II) citrate solution was then added rapidly to the copper (II) sulfate solution while mixing. Under these conditions, the reduction of the copper powder was incomplete and particles had a nodular/lumpy surface appearance.

Figure 1B:
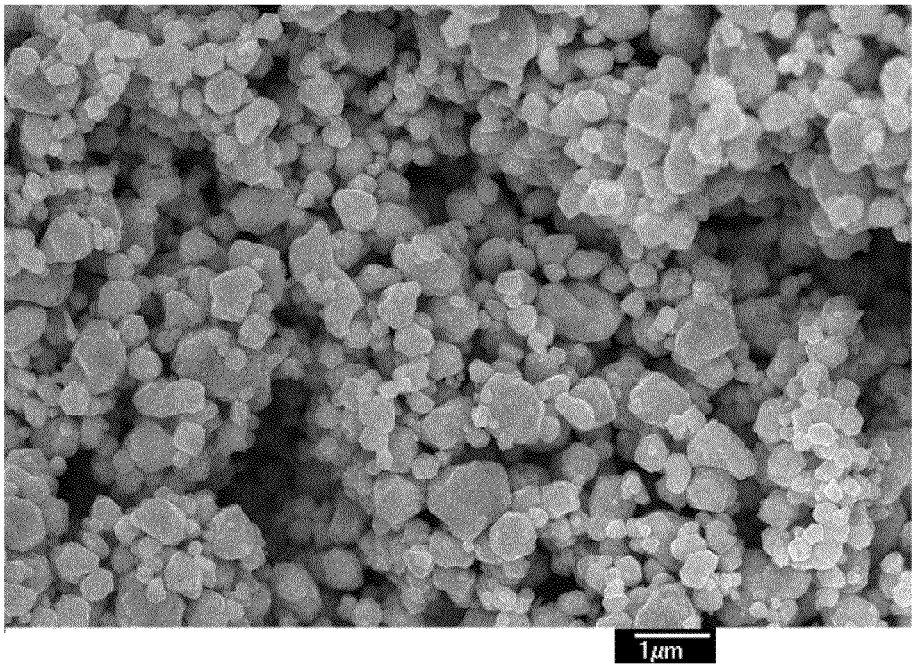
Figure 1C:
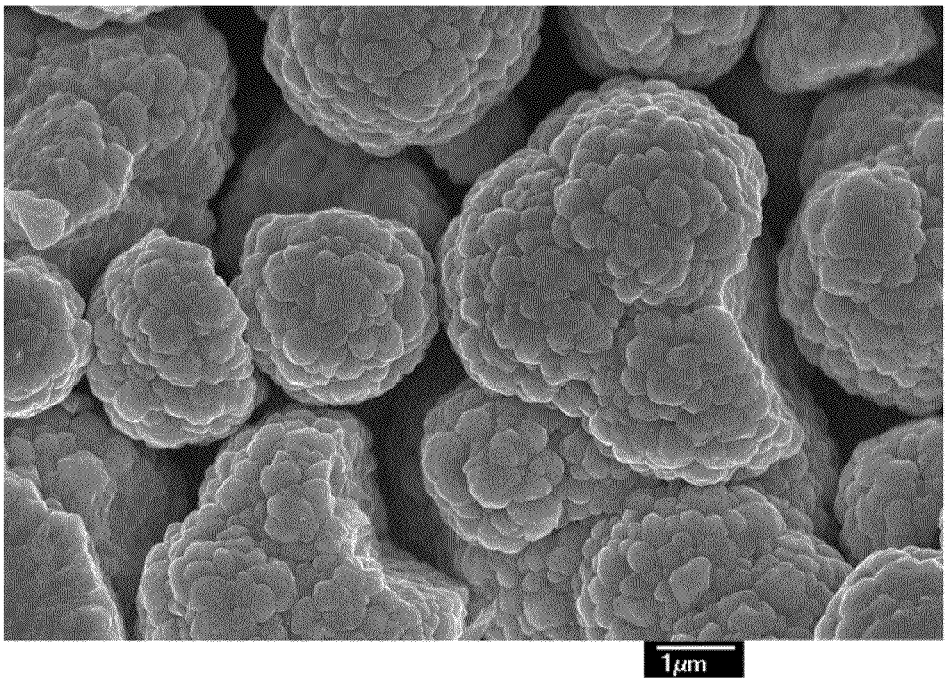

Scanning electron microscopic picture comparison of the examples with the comparative example is shown in FIG. 1.

TABLE I

Experimental conditions used for the preparation of copper particles

| Sample # | Concentration of Cu solution (mol/liter) | Concentration of Na citrate solution (mol/liter) | Concentration of ferrous sulfate solution (mol/liter) | Ferrous sulfate: Sodium citrate molar ratio | Yield (% wt pure copper) | Temperature (° C.) | Particle Size microns | Crystallite Size nm |
|---|---|---|---|---|---|---|---|---|
| 1 | 0.235 | 0.76 | 0.43 | 1.76 | 100 | 20 | 1.5 | 42 |
| 2 | 0.235 | 0.57 | 0.36 | 1.58 | 100 | 20 | 2.0 | 43 |
| 3 | 0.235 | 0.76 | 0.43 | 1.76 | 100 | 60 | 0.5 | 24 |

What is claimed is:

1. A method for the manufacture of easily dispersed, stable to oxidation, crystalline, copper powders in the absence of polymeric dispersants comprising the sequential steps:

a. forming a Cu(I) solution by dissolving a Cu(I) salt in deionized water, wherein the Cu(I) salt is selected from the group consisting of cuprous chloride, cuprous acetate and cuprous bromide;

b. forming a Fe(II) salt solution by dissolving a Fe(II) salt in deionized water;

c. forming a carboxylic acid solution by dissolving a carboxylic acid or a salt of a carboxylic acid in deionized water, d. forming a reducing Fe (II) carboxylic acid complex solution by adding the Fe (II) salt solution to the carboxylic acid solution e. rapidly adding the reducing Fe(II) carboxylic acid complex solution to the Cu(I) solution f. continuing to stir the solution until all of the copper has been precipitated and copper particles have been formed;

g. allowing the copper particles to settle followed by removal of a supernatant, washing the copper particles, collecting them, and then drying them.

2. The method of claim 1 wherein the Fe(II) salt is selected from the group consisting of ferrous sulfate, ferrous chloride, ferrous citrate and ferrous thiocyanate.

3. The method of claim 1 wherein the carboxylic acid solution is a deionized water solution of citric acid, oxalic acid, malonic acid, or succinic acid.

4. The method of claim 1 wherein the carboxylic acid solution is a deionized water solution of citric acid.

5. The method of claim 1 where the Fe (II) salt solution is added to the copper (I) solution at an operating temperature between 20° C. and 60° C.

6. A method for the manufacture of copper particles comprising the sequential steps:

a. providing a Cu(I) solution, wherein the solution comprises water, and a Cu(I) salt is selected from the group consisting of cuprous chloride, cuprous acetate and cuprous bromide;

b. providing a Fe(II) solution, wherein the solution comprises water;

c. providing a carboxylic acid solution, wherein the solution comprises water;

d. combining the Fe (II) solution and the carboxylic acid solution, forming a reducing Fe (II) carboxylic acid complex solution; and e. combining the reducing Fe(II) carboxylic acid complex solution and the Cu(I) solution to form copper particles.

* * * * *